United States Patent [19]

Komine

[11] Patent Number: 4,483,081

[45] Date of Patent: Nov. 20, 1984

[54] HEAD SUPPORTING DEVICE FOR UNIVERSAL PARALLEL RULER

[75] Inventor: Takashi Komine, Saitama, Japan

[73] Assignee: Asahi Seimitsu Kabushiki Kaisha, Tokyo, Japan

[21] Appl. No.: 433,996

[22] Filed: Oct. 13, 1982

[30] Foreign Application Priority Data

Oct. 20, 1981 [JP] Japan ..... 56-155810[U]

[51] Int. Cl.[3] ..... B43L 13/02

[52] U.S. Cl. ..... 33/438; 33/489

[58] Field of Search ..... 33/489, 438, 441, 442, 33/439, 440

[56] References Cited

U.S. PATENT DOCUMENTS 3,823,479 7/1974 Komabayashi et al. ..... 33/438

4,333,245 6/1982 Iseya et al. ..... 33/438

FOREIGN PATENT DOCUMENTS 949993 9/1956 Fed. Rep. of Germany ..... 33/438

*Primary Examiner*—William D. Martin, Jr.

*Attorney, Agent, or Firm*—Birch, Stewart, Kolasch & Birch

[57] ABSTRACT

A head supporting device for moving a universal parallel ruler containing a head assembly and a scale in a vertical direction in planes substantially parallel to that of a drawing board which comprises a cursor-side link member, a head supporting link member for supporting said head assembly and scale, a support lever disposed between said cursor-side link member and said head supporting link member, one end portion of said support lever being pivotally attached to said cursor-side link member and the other end portion thereof being pivotally attached to said head supporting link member, thereby permitting vertical movement of the head supporting link member relative to said cursor-side link member and a spring member attached to said cursor-side link member and said head supporting link member for raising the head supporting link member relative to the cursor-side link member, said spring member acting upon the support lever to raise the head supporting link member when the pivot point of the support lever on said cursor-side link member falls below a straight line connecting the attachment points of the spring member to each of said link member.

6 Claims, 5 Drawing Figures

HEAD SUPPORTING DEVICE FOR UNIVERSAL PARALLEL RULER

BACKGROUND AND SUMMARY OF THE INVENTION

The present invention relates to a head supporting device for a universal parallel ruler wherein the head assembly and the scale are floatingly supported from the plane of drawing board.

Devices are well known in which the head of a ruler is upwardly biased by a spring member. With this type of prior art device, however, it becomes more and more difficult to hold the head assembly resting on the drawing board as the inclination of the drawing board increases with respect to the horizontal plane, since the biasing effect of the spring member is at a maximum when the head assembly rests on the drawing board but decreases as the head assembly is displaced in the upward direction.

Accordingly, an object of the present invention is to provide an improved head supporting device for the universal parallel ruler, in which an upward force supporting the head assembly together with the scale increases as the head assembly is displaced in the upward direction together with the scale, with respect to the plane of drawing board and is effectively adjustable in accordance with the inclination of the drawing board with respect to the horizontal position.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 3:
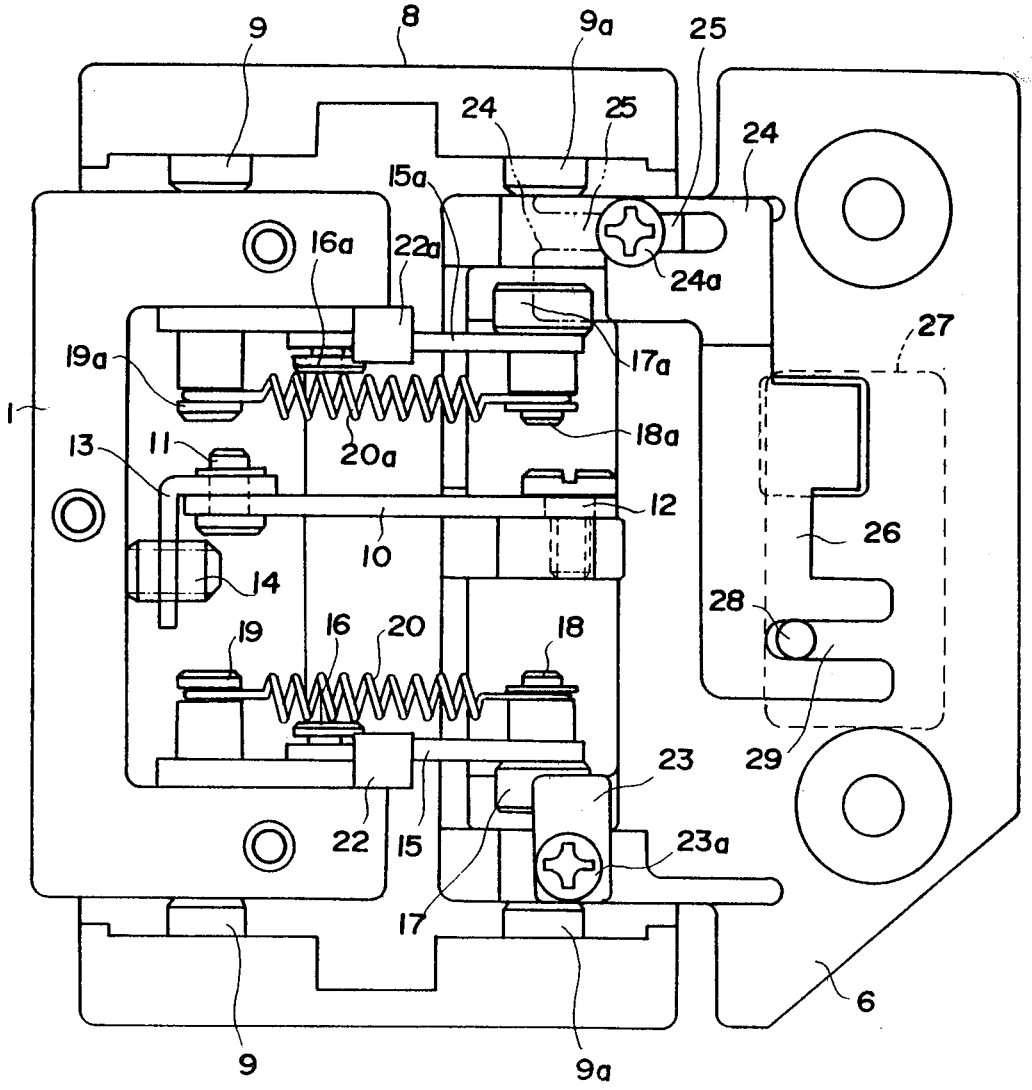
FIG. 3 is a bottom view of the embodiment of FIG. 1.

The device according to the present invention will now be described in detail with reference to the accompanying drawings wherein reference numeral 1 designates a cursor-side link fixed by clamp screws 3 to a cursor plate 2 so as to be in unison therewith. The cursor plate 2 is movably guided by travelling rollers 5 on a longitudinal rail 4. Reference numeral 6 designates a head supporting link adapted to support a head assembly 7 in unison therewith and this head supporting link 6 is connected by a parallel motion mechanism with said cursor-side link 1 so that said head supporting link 6 may be vertically moved substantially in parallel to said cursor-side link 1. In the embodiment shown, both links 1 and 6 have their upper portions connected by pivots 9 and **9*a* to an upper link 8 and their lower portions connected by pivots 11, 12, to a lower link 10, as seen in FIG. 3. The pivots 9, 9*a*, 11, and 12 of said upper and lower links 8, 10 are arranged on respective corners of a substantially formed parallelogram, and thereby a parallel motion mechanism is established. According to this specific embodiment, it is also provided that the pivot 11 of the lower link 10 associated with the cursor-side link 1 is arranged on a rocking end of a rocking member 13 adapted to be rocked around an axis substantially coaxial with the pivot 9 of the upper link 8. An adjusting screw 14 arranged on the lower end of said rocking member 13 permits an adjustment of the parallel motion so that the head supporting link 6 may be rotated around the pivot 9*a*** upwards over a large angle, collapsing the parallelogram.

In the embodiment of the head supporting device according to the present invention, a support lever 15 is rotatably mounted on the cursor-side link 1 around a pivot 16 and is provided at a rocking end with a roller 17 serving as lifting means. The roller 17 normally bears against a lower surface **6*a* of the head supporting link 6. The rocking end of the support lever 15 is also provided with a pin 18 for anchoring a spring member 20. Behind the pivot 16 there is provided a pin 19 similar to pin 18 on the cursor-side link 1 so that both pins 18 and 19 lie in a substantially horizontal plane and the spring member 20 attached to pins 18 and 19 biases roller 17 with a tensile force to lift the link 6. The lifting force of the spring member 20 is not effective when the spring anchoring pins 18 and 19 and the pivot 16 lie in a straight line or the pivot 16 comes above the straight line connecting both spring anchoring pins 18, 19 but acts upon the support lever 15 first when the pivot 16 falls below the straight line connecting anchoring pins 18 and 19. Furthermore, the lifting force of the spring member 20 acting upon the support lever 15 increases as the latter is rocked upwards, since such a rocking of the support lever 15 results in an increase in the tensile angle. To limit the rocking extent of the support lever 15, the cursor-side link 1 is provided with upper and lower limit stoppers 21 and 22 against which said support lever 15 engages in its upper and lower limit positions, respectively. When the support lever 15 is in its upper limit position, the head assembly is floated together with the scale above the drawing board and, when the support lever 15 is in its lower limit position, the head assembly and the scale rest on the drawing board. Reference numeral 23 designates an interlocking projection mounted by a screw 23*a* on the lower side of the head supporting link 6 so as to bear against said roller 17**.

This embodiment of the present invention further includes another head supporting device substantially in parallel to the previously mentioned head supporting device, for the purpose of reinforcement. As will be apparent from the rear view of FIG. 4, the reinforcing head supporting device comprises, in the same manner as the main head supporting device, a support lever **15*a*, a pivot 16*a*, a roller 17*a*, spring anchoring pins 18*a* and 19*a*, a lifting spring member 20*a*, an upper limit stopper 21*a* and a lower limit stopper 22*a*. The reinforcing head supporting device is identical to the main head supporting device in its function as well as the effect of the supporting lever 15***a*. The reinforcing head supporting device is thus identical to the main head supporting device except that an interlocking projection 24 located below the roller 17*a* serving as the lifting means of the support lever 15*a* is provided with a slide groove 25 and said interlocking projection 24 is selectively mounted by a clamp screw 24*a* on the retracted position as shown by the solid line or an interlocking position as shown by the broken line in FIGS. 3 and 4.

Figure 4:
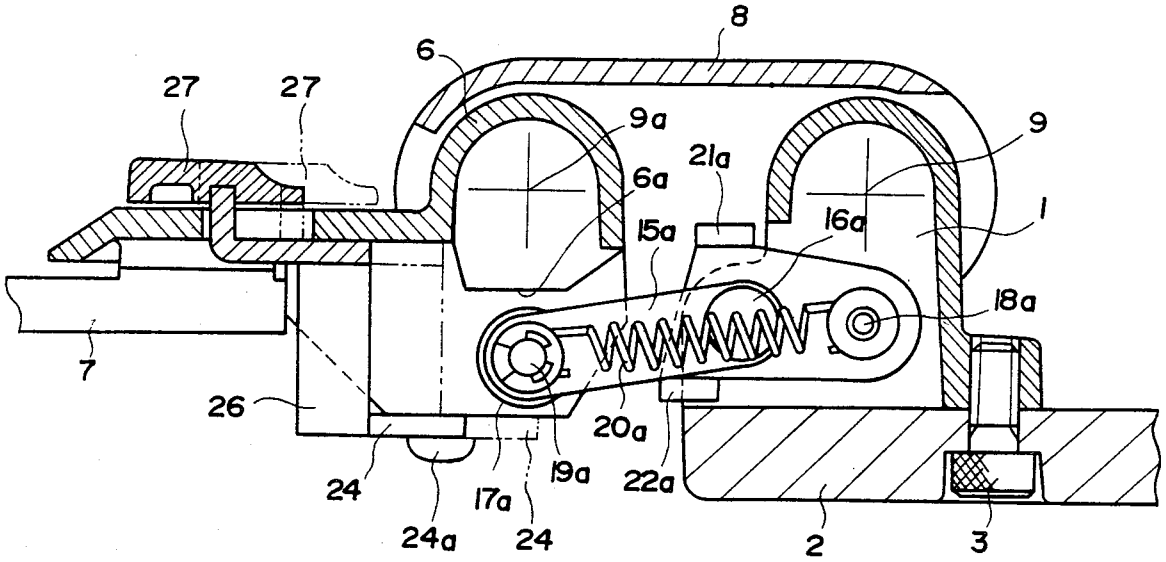
FIG. 4 is a rear view schematically showing other elements of the present invention.
Figure 5:
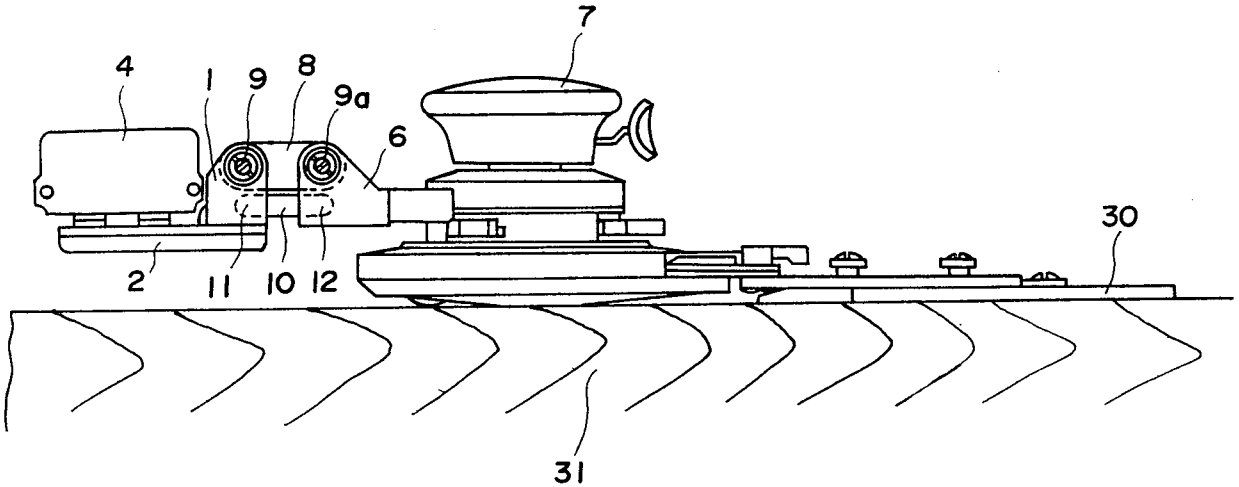
FIG. 5 is a frontal view schematically showing the manner in which the device of the present invention operates as a whole.

The interlocking projection 24 is operatively associated by an interlocking member 26 with an operating lever 27 mounted on the head supporting link 6 so that movement of the operating lever 27 from the position shown by the solid line to the position shown by the broken line in FIG. 4 causes the interlocking projection 24 to be brought into contact with the roller 17*a* and vice versa. Such arrangement permits the head supporting device, for the purpose of reinforcement, to be easily changed over between its operative engagement and disengagement positions. Referring to FIG. 3, reference numeral 28 designates a guide pin for the interlocking member 26 and reference numeral 29 designates a slit formed in said interlocking member 26, along which the guide pin 28 displaces. Referring to FIG. 5, reference numeral 30 designates the scale and reference numeral 31 designates the drawing board.

Figure 1:
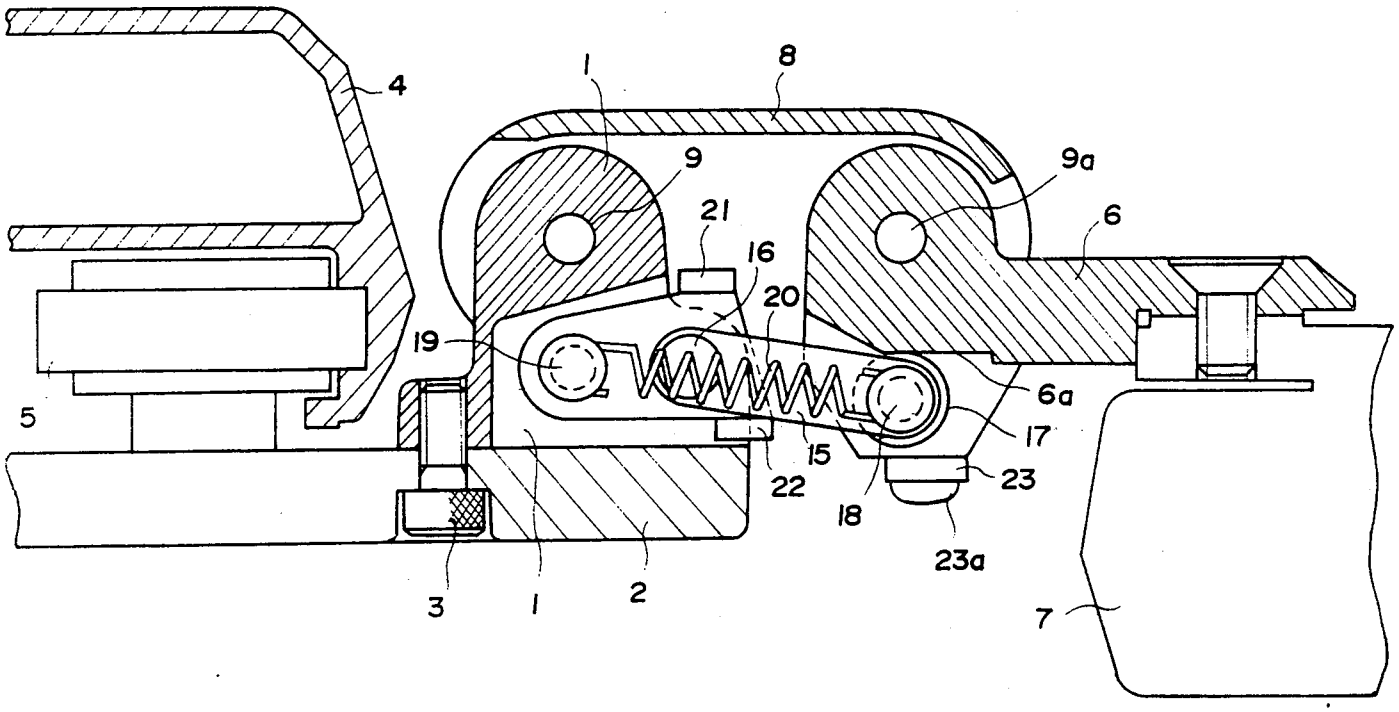
FIG. 1 is a frontal view schematically showing an embodiment of the present invention, partially in longitudinal section.
Figure 2:
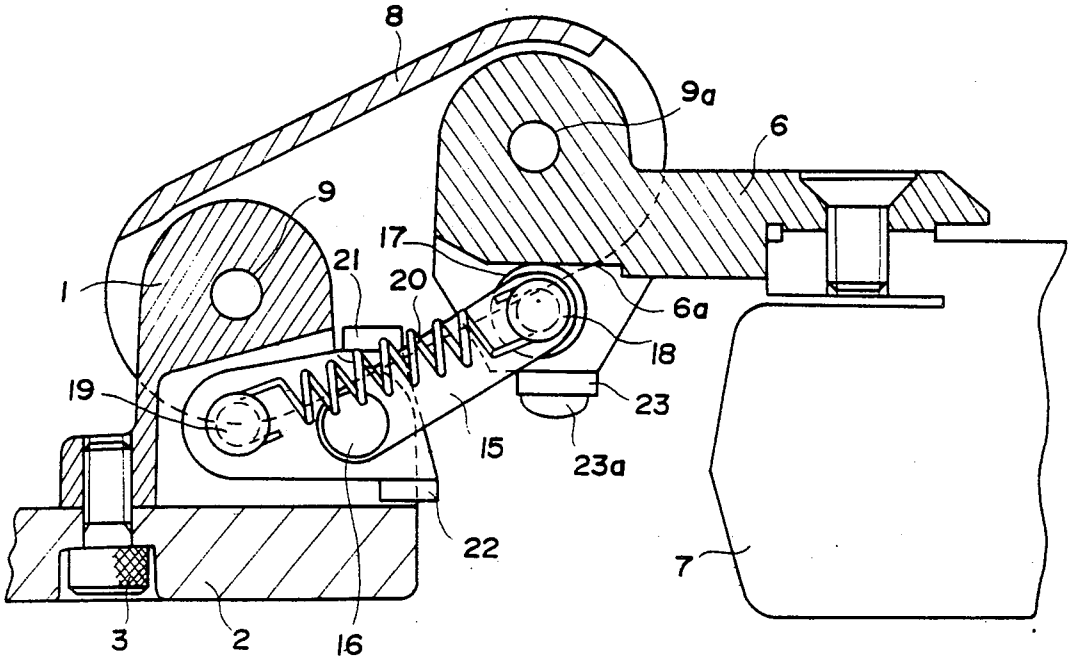
FIG. 2 is a frontal view schematically showing the manner in which the embodiment of FIG. 1 functions.

The manner in which the device according to the present invention functions will now be described. In the state as shown by FIG. 1, the support lever 15 occupies a position at which the pivot 16 of the support lever 15 lies slightly above a straight line connecting the pins 18 and 19 between which the lifting spring member 20 is suspended. Thus the support lever 15 is biased by the lifting spring member 20 to rotate clockwise around the pivot 16 and accordingly bears against the lower limit stopper 22. Thus, the support lever 15 exerts no lifting force on the head supporting link 6 and the head 7 together with the scale is caused to rest on the drawing board. When the head 7 is manually lifted, the interlocking projection 23 is brought into contact with the lower surface of the roller 17 and simultaneously rotates the support lever 15 counterclockwise. When the support lever 15 reaches the position at which the pivot 16 of the support lever 15 lies below the straight line connecting the spring anchoring pins 18, 19, the lifting force of the spring member 20 is exerted via the roller 17 on the lower surface 6*a* of the head supporting link 6. In the course of such operation, the angle defined between the spring member 20 and the support lever 15 is enlarged and, therefore, the biasing force of the spring member 20 acting upon the support lever 15 is also increased as the support lever 15 is rotated upwards together with the head assembly 7. Thus, the head assembly 7 together with the scale is maintained in their floating positions above the drawing board with the support lever 15 bearing against the upper stopper 21 as shown in FIG. 2. In the case where the head assembly and the scale are too loaded to be held floating only by the lifting force of the spring member 20 arranged in the main head supporting device due to the drawing board being inclined only slightly relative to the horizontal, the interlocking projection 24 of the reinforcing head supporting device is brought into contact with the roller 17*a* of the support lever 15*a* and fixed in this position so that the spring member 20*a* also simultaneously may act via the support lever 15*a* upon the head supporting link 6 and thereby effectively hold the head assembly in a floating state together with the scale.

Obviously, a modified embodiment of the present invention is also possible, in which the pivots 16 and 16*a* of the support levers 15 and 15*a* are arranged in upper portions of the head supporting link 6 and the roller 17 is brought into contact with the cursor-side link 1 so that the cursor-side link 1 may be biased by the spring members 20, 20*a* and the head supporting link 6 may be held upwards relative to the cursor-side link 1.

It will be apparent from the foregoing description that, with the device according to the present invention, the head assembly and the scale may be reliably held in floating positions, since the angle with which the lifting force of the spring member acting upon the support lever and, therefore the lifting force itself increases as the head assembly and the scale move in the upward direction from their positions at which these head assembly and scale bear against the drawing board in the course of supporting the head supporting link 6 with respect to the cursor-side link 1 by the support lever adapted to be rocked as the head assembly and the scale are lifted. On the other hand, the lifting force of the spring member decreases as the head assembly and the scale are lowered towards the drawing board so that the head assembly and the scale may be held resting on the drawing board. Furthermore, in the previously mentioned case in which the head assembly and the scale are too highly loaded to be effectively supported by a single head supporting device due to the inclination of the drawing board at a position near to the horizontal, the additional head supporting device provided according to the present invention for the purpose of reinforcement may be utilized to reinforce the supporting force for the head assembly sufficient to hold the head assembly and the scale in an optimum floating condition in accordance with the inclination of the drawing board.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A head supporting device for moving a universal parallel ruler containing a head assembly and a scale in a vertical direction in planes substantially parallel to that of a drawing board which comprises a cursor-side link member, a head supporting link member for supporting said heat assembly and scale, a parallel motion mechanism mounting said head supporting link member on said cursor-side link member for moving said head assembly and scale away from and into contact with the surface of the drawing board while said supporting link member is maintained parallel to the surface of the drawing board, a support lever disposed between said cursor-side link member and said head supporting link member, one end portion of said support lever being pivotally attached to said cursor-side link member and the other end portion thereof in engagement with the supporting surface of said head supporting link member, thereby lifting the head supporting link member upwardly relative to said cursor-side link member and a spring member attached to said cursor-side link member and said support lever for raising the head supporting link member relative to the cursor-side link member, said spring member acting upon the support lever to raise the head supporting link member when the pivot point of the support lever on said cursor-side link member falls below a straight line connecting the attachment points of the spring member to each of said cursor-side link member and said support lever.

2. The device of claim 1 wherein the spring member is attached at one end to an anchoring pin member disposed adjacent the pivot point of the support lever on the cursor-side link member and at the other end to an anchoring pin member disposed adjacent the rocking end of the support lever.

3. The device of claim 1 wherein the cursor-side link member is provided with upper and lower limit stoppers against which the support lever engages in its upper and lower limit positions.

4. A head supporting device for moving a universal parallel ruler containing a head assembly and a scale in a vertical direction in planes substantially parallel to that of a drawing board which comprises a cursor-side link member, a head supporting link member for supporting said head assembly and scale, a parallel motion mechanism mounting said head supporting link member on said cursor-side link member for moving said head assembly and scale away from and into contact with the surface of the drawing board while said supporting link member is maintained parallel to the surface of the drawing board, a pair of support levers disposed between said cursor-side link member and said head supporting link member, one end portion of each of said support levers being pivotally attached to said cursor-side link member and the other end portion of each of said support levers thereof in engagement with the supporting surface of said head supporting link member, thereby lifting the head supporting link member upwardly relative to said cursor-side link member and spring members respectively attached to said cursor-side link member and said support lever for raising the head supporting link member relative to the cursor-side link members, said spring members acting upon the support levers to raise the head supporting link member when the pivot point of the support levers on said cursor-side link member falls below a staight line connecting the attachment points of the spring members to each of said cursor-side link member and said support levers, whereby either one of the support levers can be maintained at its lower limit position as a reinforcing function.

5. The device of claim 4 wherein the spring members are attached at one end to anchoring pin members disposed adjacent the pivot point of the support levers on the cursor-side link member and at the other end to anchoring pin members disposed adjacent the rocking ends of the support levers.

6. The device of claim 4 wherein the cursor-side link member is provided with upper and lower limit stoppers against which the support levers engage in their upper and lower limit positions.

* * * * *